US007934277B1

(12) United States Patent
Shu

(10) Patent No.: US 7,934,277 B1
(45) Date of Patent: May 3, 2011

(54) MATTRESS STRUCTURE

(76) Inventor: Han-Chung Shu, Taipei (TW)

( * ) Notice: Subject to any disclaimer, the term of this patent is extended or adjusted under 35 U.S.C. 154(b) by 0 days.

(21) Appl. No.: 12/877,275

(22) Filed: Sep. 8, 2010

(51) Int. Cl.
*A47C 23/06* (2006.01)

(52) U.S. Cl. ..... 5/690; 5/697; 5/936

(58) Field of Classification Search ..... 5/690, 716, 5/697, 936, 727; 267/177, 170
See application file for complete search history.

(56) References Cited

U.S. PATENT DOCUMENTS 6,003,178 A * 12/1999 Montoni ..... 5/690
6,487,738 B1 * 12/2002 Graebe ..... 5/719
2008/0276377 A1 * 11/2008 Hsu ..... 5/727
* cited by examiner

*Primary Examiner* — Fredrick Conley
(74) *Attorney, Agent, or Firm* — Ming Chow; Sinorica, LLC

(57) ABSTRACT

A mattress structure is a mattress body and comprises: a fixed plate, which has a plurality of flexible accommodating holes and at least one first flexible member; a moving plate, which has at least one second flexible member corresponding to the flexible accommodating hole, the moving plate is below the fixed plate and has a distance with the fixed plate for moving; at least one lifting device, which is combined with the bottom of the moving plate, the moving plate and the second flexible member move up and down via the lifting device in order to let that the second flexible member penetrates through the flexible accommodating holes and protrudes out of the top surface of the fixed plate.

10 Claims, 10 Drawing Sheets

MATTRESS STRUCTURE

BACKGROUND OF THE INVENTION

1. Field of the Invention

The present invention generally relates to a mattress structure, more particularly to a mattress structure that is adjustable in the field of support forces in order to provide different support forces for different users.

2. Description of the Prior Art

Under the leadership of science and technology, the life is always fast and in pressure. At the end of a day, everybody needs a good sleep to completely relax the body for the next day.

Except for work and normal life, 30% time is for sleep for a human being. The quality of a sleep may directly affect the health of the human being. Accordingly, demands to a mattress may then be more than ever. The prior mattresses are mostly made by the way of integration molding, and the softness of a mattress shall be adjusted based on the requirements of a user. It costs a lot as always and is inconvenient. The prior mattress structure has a mattress body and a flexible member in the mattress body, but it is full of disadvantages listed below:

1. After using a period of time, partial of the flexible member is damaged as a sunken portion so as to affect sleep.
2. The flexibility of each part of the surface of the prior mattress structure is the same and may not be changed; the flexibility cannot be adjusted according to different users as well.
3. Since the flexible member is made by integration molding, a chain reaction can happen. If two people with different sleep habits lie on a bed, one people may be affected by another. Hence, an option for solving the problem is to purchase another mattress structure for more comfortable, but it is definitely not an economic way.

Thereby, to develop a new type of mattress structure to is an issue for the skilled persons in the art and may be discussed hereinafter.

SUMMARY OF THE INVENTION

The main objective of the present invention is to is provide a mattress structure, wherein a moving plate can be adjusted for moving up and down so as to let the support forces of a first flexible member be integrated with the support forces of a second flexible member of the moving plate. Hence, the total support force of the mattress structure is adjustable for different users. So that the lowering distance of the mattress structure is controllable.

To reach above objective, the mattress structure is a mattress body and comprises: a fixed plate, which has a plurality of flexible accommodating holes and at least one first flexible member and is fixed in the mattress body, the flexible accommodating holes is at the bottom of the first flexible member; a moving plate, which has at least one second flexible member corresponding to the flexible accommodating hole, the second flexible member is able to move up and down via the internal of the first flexible member, the moving plate is below the fixed plate; and at least one lifting device, which is combined with the bottom of the moving plate, wherein the lifting device comprises a motor and a power-output axis disposed at the motor and connected with the moving plate in order to let the moving plate move up and down via the power-output axis.

The lifting device moves the moving plate up to the fixed plate, the second flexible members then penetrate through the flexible accommodating holes. Meanwhile, not only the first flexible members are to support the user, but also the second flexible members do. Hence, the support forces are enhanced; otherwise, to activate the lifting device and the motor is to lower down the moving plate, then the second flexible members are lowered down either so as to make that only the first flexible members support the user. That is, the support forces are decreased.

Preferably, the flexible accommodating holes are not only disposed at the bottom of the first flexible members, but also disposed between first flexible members. So that when the second flexible members move up through the moving plate, the support forces of the mattress structure are still controllable due to that each flexible accommodating hole is between two first flexible members.

Preferably, the lifting devices are disposed at the four corners of the moving plate.

Preferably, the lifting devices are disposed at the central portion of the moving plate.

Preferably, the power-output axis of the lifting device is a ball screw rod.

Preferably, the first flexible member and the second flexible member adopt a cell arrangement.

Preferably, the first flexible member and the second flexible member adopt a parallel arrangement.

Preferably, the first flexible member and the second flexible member adopt a regulated and staggered arrangement.

Preferably, a flexible layer is disposed on the surface of the first flexible member a package wraps around the mattress body in order to promote the effect of sleep.

Preferably, the lifting device is connected with a remote receiver and a remote radiator, the remote radiator is capable of radiating signals to the remote receiver for a user controlling the lifting device.

Preferably, a gap between the first flexible member and the second flexible member is disposed a guiding member.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
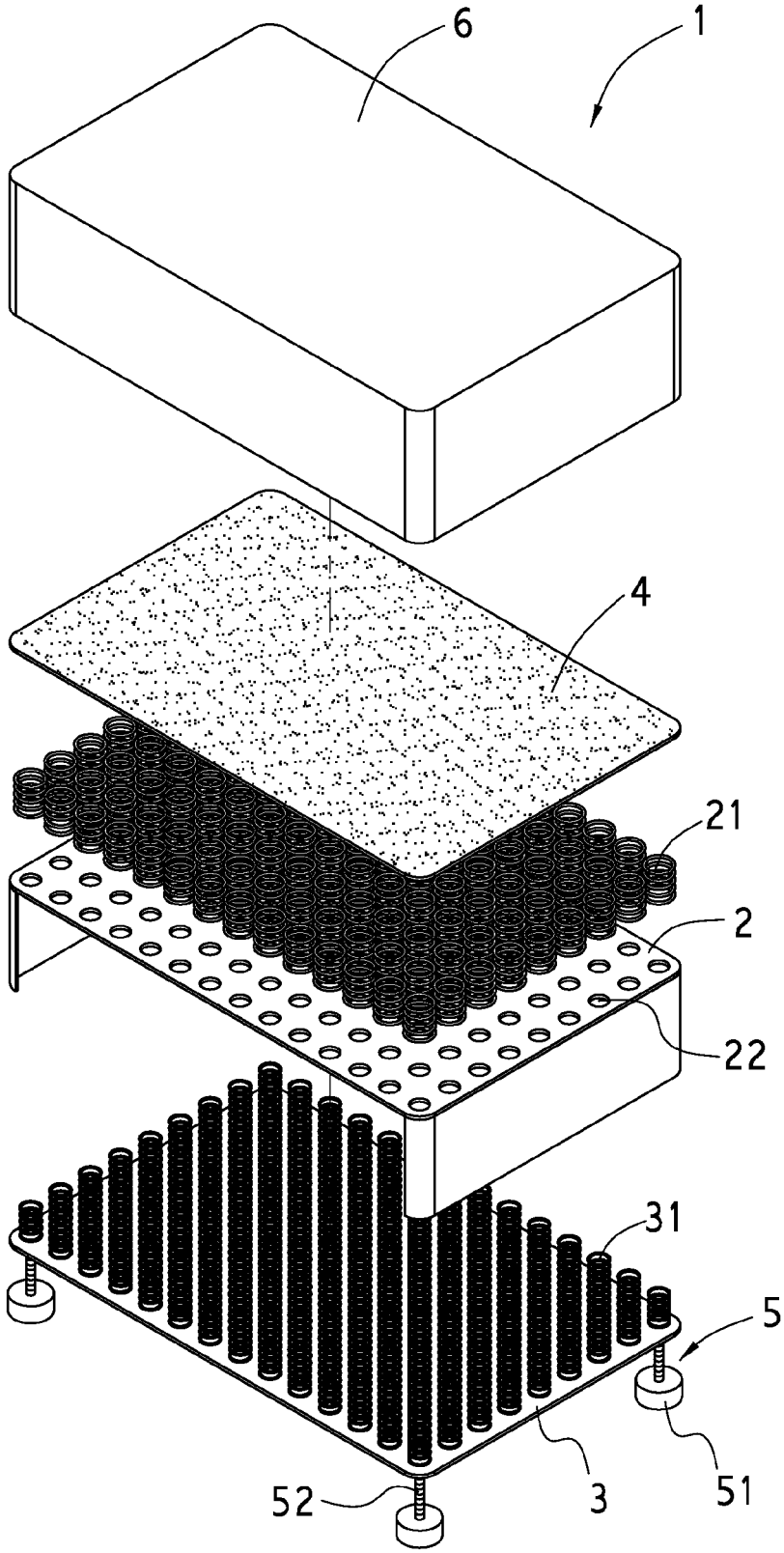
FIG. 1 illustrates a schematic 3-D exploded view of a mattress structure of the present invention.
Figure 2:
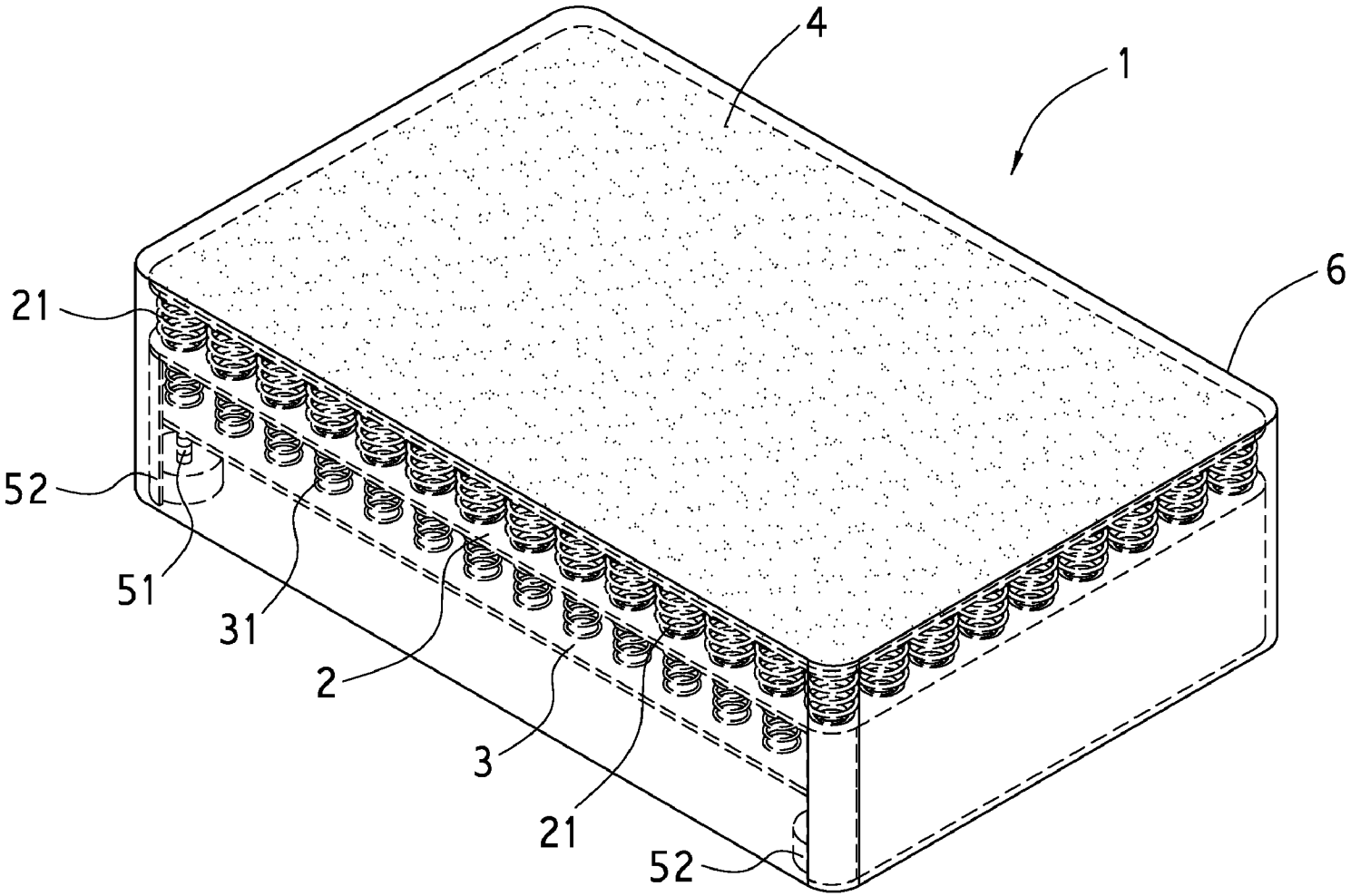
FIG. 2 illustrates a schematic 3-D assembled view of the mattress structure of the present invention.
Figure 3:
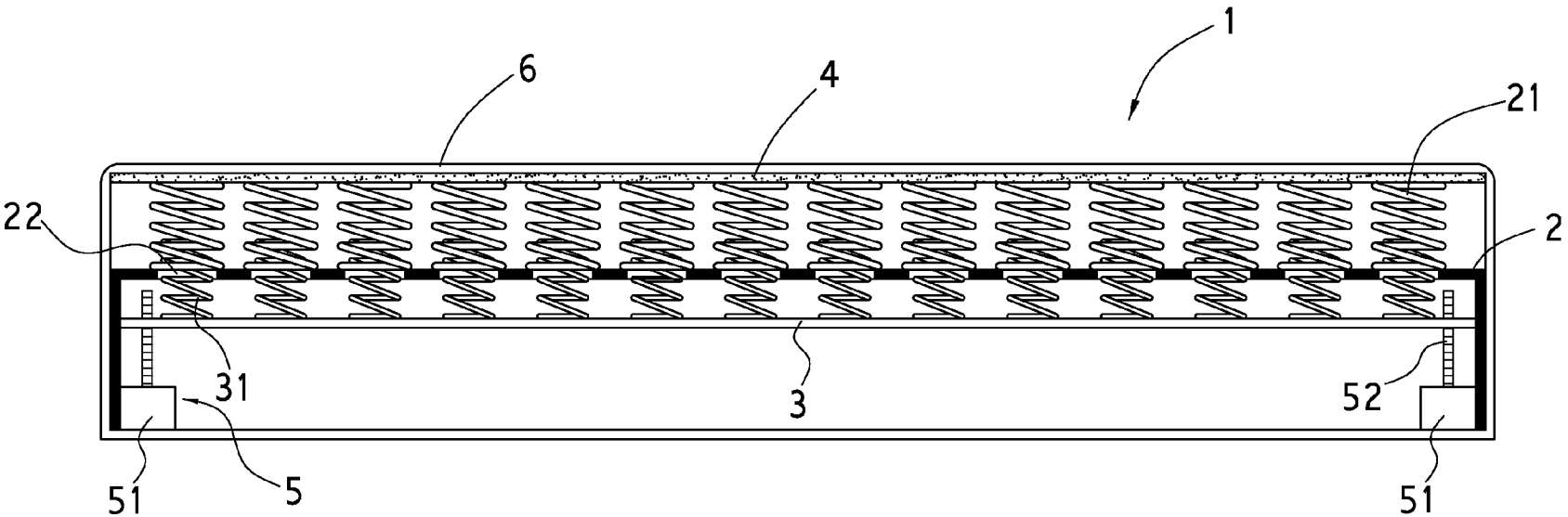
FIG. 3 illustrates a schematic action sectional view of the mattress structure of the present invention.

With references to FIG. 1 to FIG. 3, which illustrate a schematic 3-D exploded view of a mattress structure of the present invention, a schematic 3-D assembled view of the mattress structure of the present invention and a schematic action sectional view of the mattress structure of the present invention. The mattress structure is a mattress body 1, which includes:

a fixed plate 2, which is disposed in the mattress body 1 and has a plurality of flexible accommodating holes 22, the outer rim of the top surface of each flexible accommodating hole 22 is combined with a first flexible member 21, the flexible accommodating hole 22 is corresponding to the space of the first flexible member 21;

a moving plate 3, which has a plurality of second flexible members 31 corresponding to the flexible accommodating holes 22 of the fixed plate 2, the moving plate 3 is below the fixed plate 2, the second flexible member 31 is able to move upwardly from the internal of first flexible member 21;

four lifting devices 5, which is combined with the bottom of the moving plate 3, in the preferred embodiment, the four lifting devices 5 are disposed at the four corners of the bottom of the moving plate 3, but the positions for the lifting devices 5 are not limited by the preferred embodiment, another example is the central portion of the moving plate 3, each lifting device 5 includes a motor 51 and a power-output axis 52 disposed at the motor 51 and connected with the moving plate 3, the power-output axis 52 is a ball screw rod, while the motor 51 rotates, the moving plate 3 moves up and down through the power-output axis 52, further, the lifting device 5 can be connected with a remote control device (not shown in the figure), which has a remote receiver and a remote radiator (not shown in the figure), the remote receiver is electrically connected with the motor 51 and receives the signals from the remote radiator so as to control the motor 51, the remote radiator is capable of radiating the signals of activation, lifting and lowering to the remote receiver for a user controlling the lifting device 5;

a flexible layer 4, which is disposed on the surface of the first flexible member 21; and a package 6, which wraps around the fixed plate 2, the first flexible members 21, the moving plate 3, the second flexible member 31, and the lifting devices 5.

Above preferred embodiment of controlling the lifting device 5 by means of the remote control device is not to limit the scope of the present invention, other ways of manual or auto control may be included in the present invention.

Figure 4:
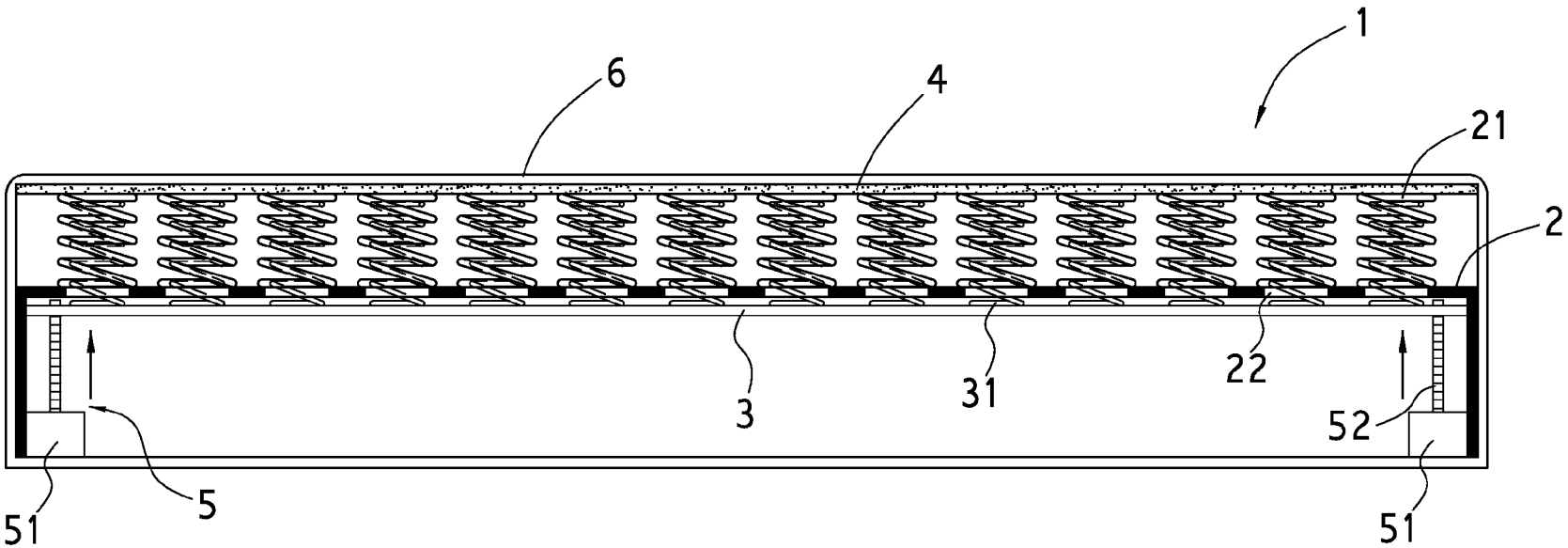
FIG. 4 illustrates a schematic sectional action view of a second flexible member of the mattress structure of the present invention.
Figure 5:
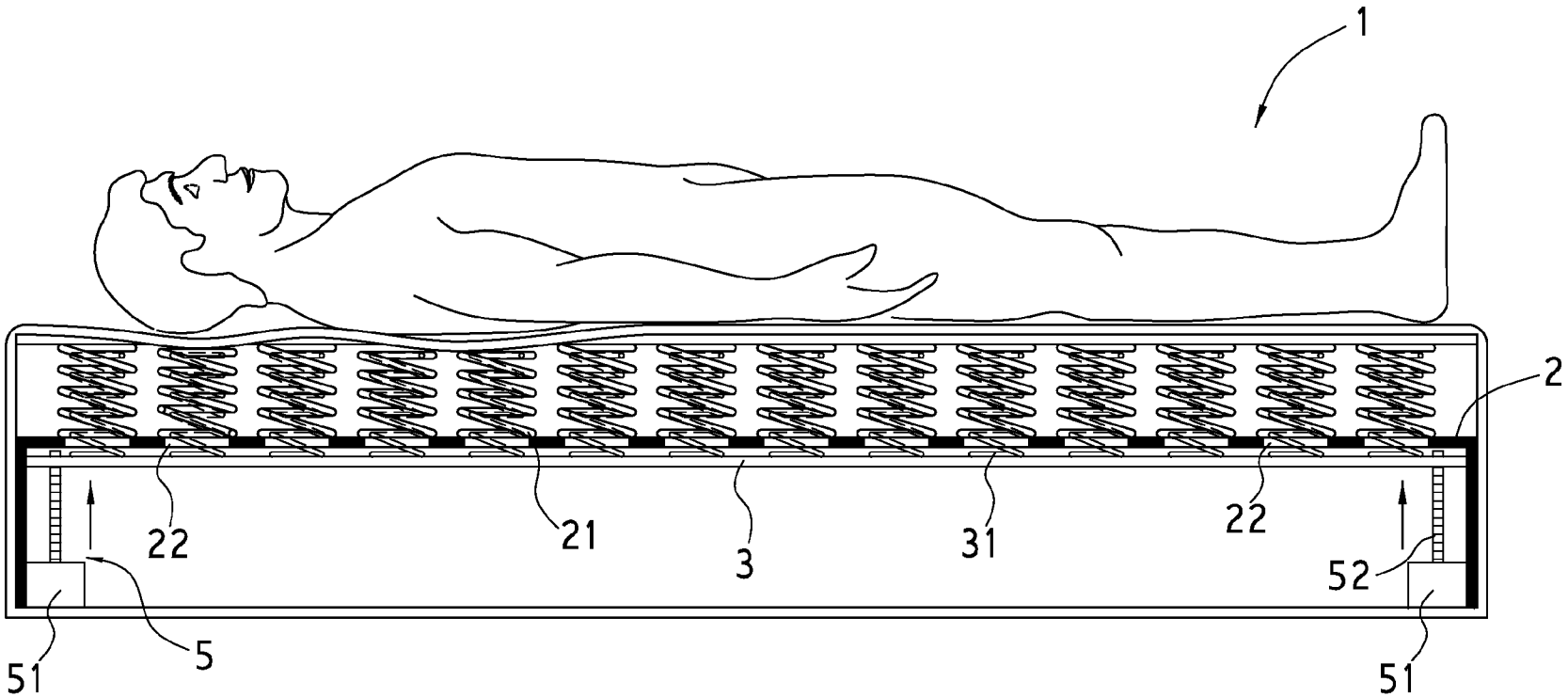
FIG. 5 illustrates a schematic sectional application view of the second flexible member of the mattress structure of the present invention.

With references to FIG. 4 and FIG. 5, which illustrate a schematic sectional action view of the second flexible member of the mattress structure of the present invention and a schematic sectional application view of the second flexible member of the mattress structure of the present invention. While the user demands that the support forces of the mattress structure are promoted, to activate the motors 51 and then to drive the power-output axes 52 are to move the moving plate 3 up to the fixed plate 2, the second flexible members 31 go through the flexible accommodating holes 22. Meanwhile, not only the first flexible members 21 are to support the user, but also the second flexible members 31 do. Hence, the support forces are enhanced; otherwise, to activate the lifting device 5 and the motor 51 is to lower down the moving plate 3, then the second flexible members 31 are lowered down either so as to make that only the first flexible members 21 support the user. That is, the support forces are decreased.

The distance for the moving plate 3 moving upward can be controlled by the user. The second flexible members 31 of the moving plate 3 can be moved up to ⅓, ½ or ⅔ height of the first flexible member 21 or the equal height or any height of the first flexible member 21. Therefore, the first flexible member 21 may have different lowering depths and different support forces while being compressed by the user.

Figure 6:
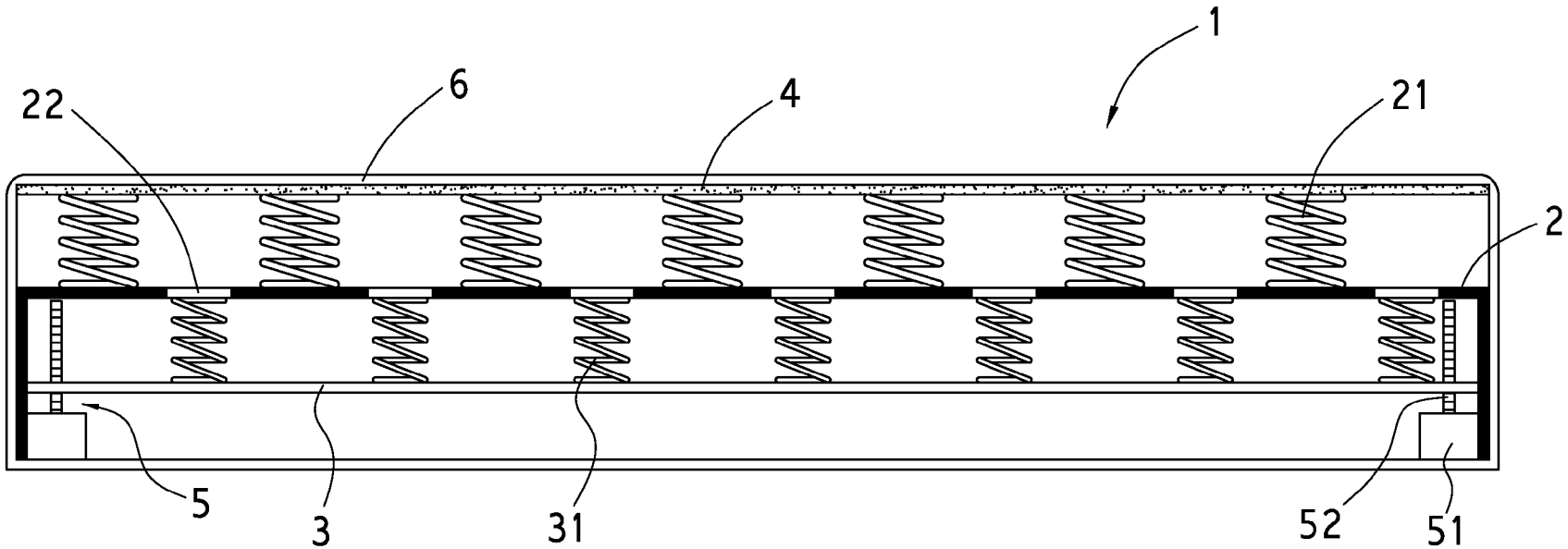
FIG. 6 illustrates a schematic sectional structural view of another preferred embodiment of the mattress structure of the present invention.

With reference to FIG. 6, which illustrates a schematic sectional structural view of another preferred embodiment of the mattress structure of the present invention. In the preferred embodiment, the flexible accommodating holes 22 of the fixed plate 2 are corresponding to the spaces of the first flexible members 21, or each flexible accommodating hole 22 is disposed between two first flexible members 21. In other words, the second flexible members 31 are staggered between two first flexible members 21. While the user demands that the support forces of the mattress body 1 are promoted, to activate the motors 51 and then to drive the power-output axes 52 are to move the moving plate 3 up to the fixed plate 2, the second flexible members 31 go through the flexible accommodating holes 22 and are disposed among the first flexible members 21. Meanwhile, not only the first flexible members 21 are to support the user, but also the second flexible members 31 do. Hence, the support forces are enhanced; otherwise, to activate the lifting device 5 and the motor 51 is to lower down the moving plate 3, then the second flexible members 31 are lowered down either so as to make that only the first flexible members 21 support the user. That is, the support forces are decreased.

Figure 7A:
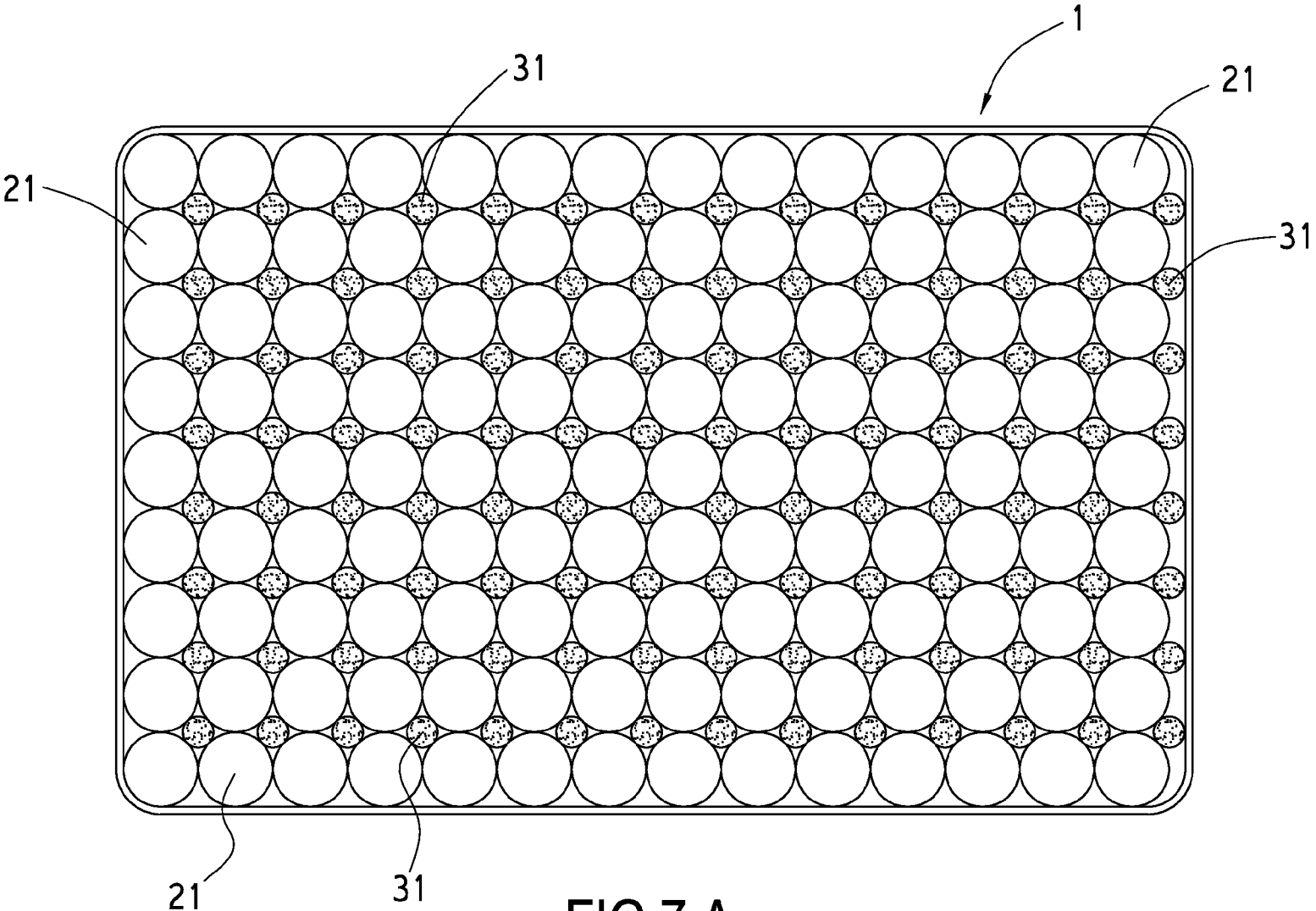
FIG. 7A illustrates a schematic arrangement view of a first surface of a first flexible member and the second flexible member of the mattress structure of the present invention.
Figure 7B:
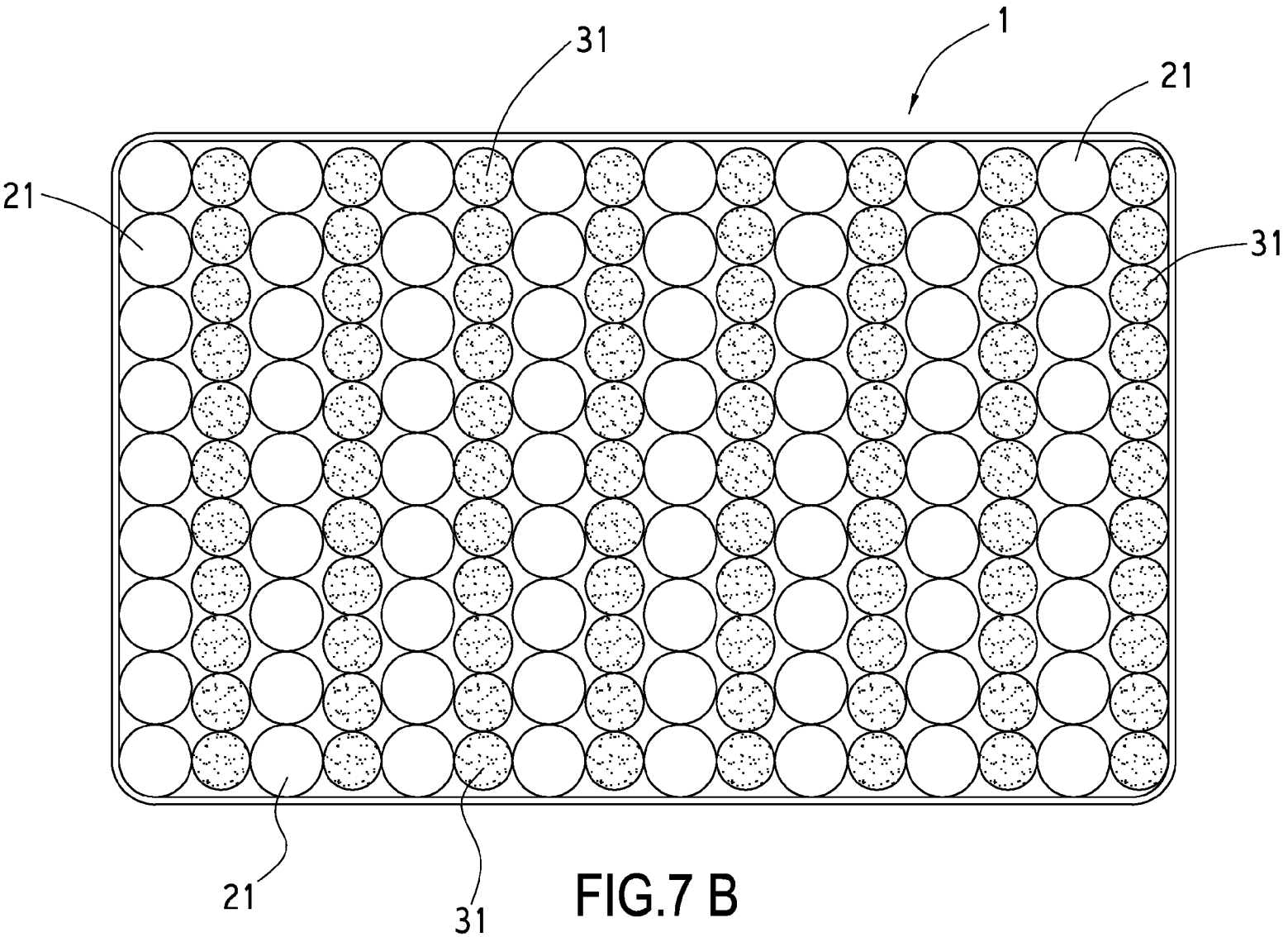
FIG. 7B illustrates a schematic arrangement view of a second surface of the first flexible members and the second flexible members of the mattress structure of the present invention.
Figure 7C:
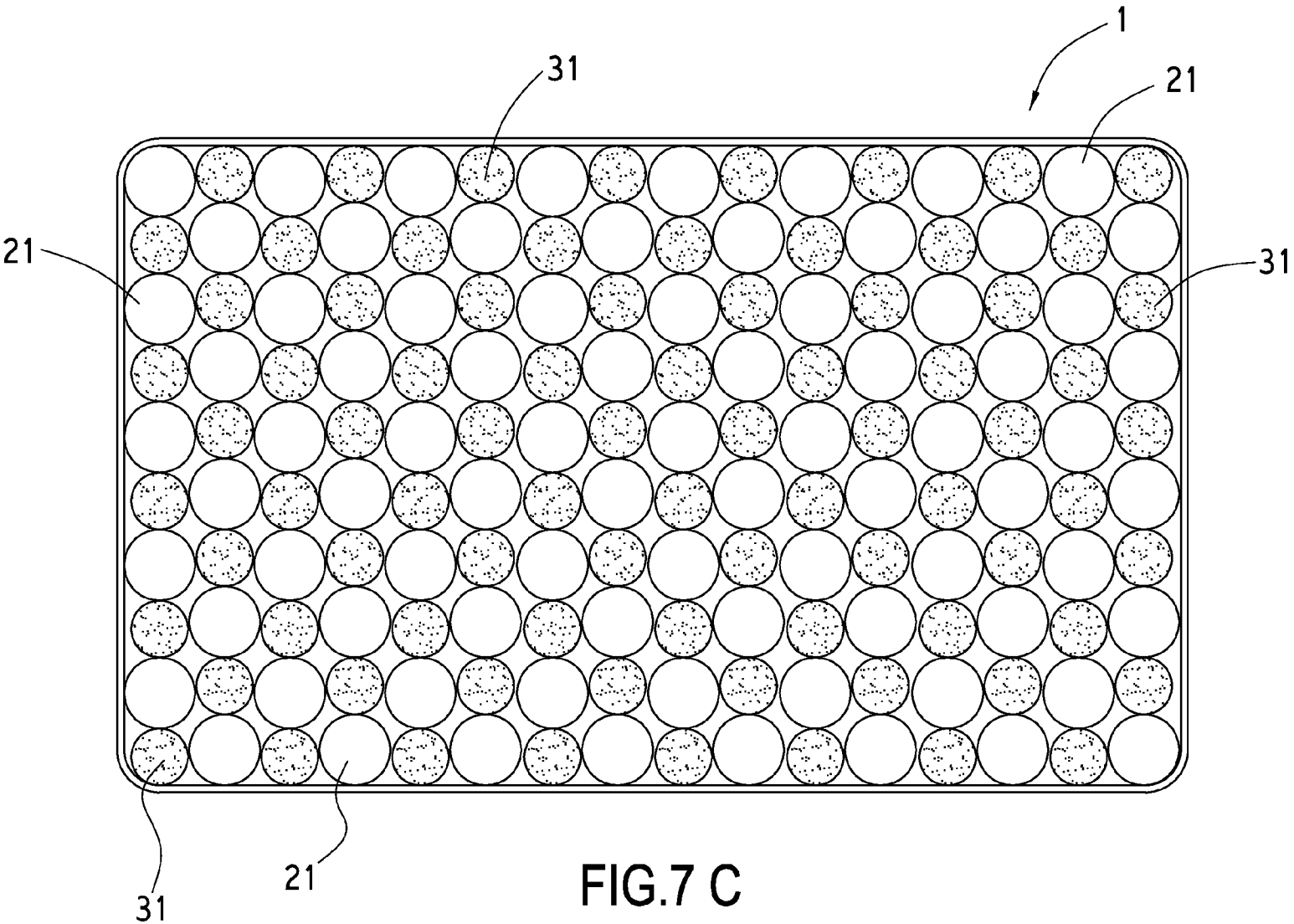
FIG. 7C illustrates a schematic arrangement view of a third surface of the first flexible member and the second flexible member of the mattress structure of the present invention.

With references to FIG. 7A, FIG. 7B and FIG. 7C, which illustrate a schematic arrangement view of a first surface of the first flexible member and the second flexible member of the mattress structure of the present invention, a schematic arrangement view of a second surface of the first flexible members and the second flexible members of the mattress structure of the present invention and a schematic arrangement view of a third surface of the first flexible member and the second flexible member of the mattress structure of the present invention. The three figures present the arrangements of the first flexible members and the second flexible members disposed on the mattress body 1 respectively. FIG. 7A presents that the first flexible members 21 and the second flexible members 31 adopt a cell arrangement, that is, the arrangement for the first flexible members 21 and the second flexible members 31 is close and intersected, such as a cell. FIG. 7B presents that the first flexible members 21 and the second flexible members 31 adopt a parallel arrangement. FIG. 7C presents that the first flexible members 21 and the second flexible members 31 adopt a regulated and staggered arrangement, that is, the arrangement defines that the first flexible members 21 and the second flexible members 31 are parallel to each other, but the positions for the first flexible members 21 and the positions for the second flexible members 31 are staggered with each other. Anyhow, no matter what the arrangement for the first flexible members 21 and the second flexible members 31 is one of above three arrangements, the function to adjust the support forces of the mattress structure can be reached.

Figure 8:
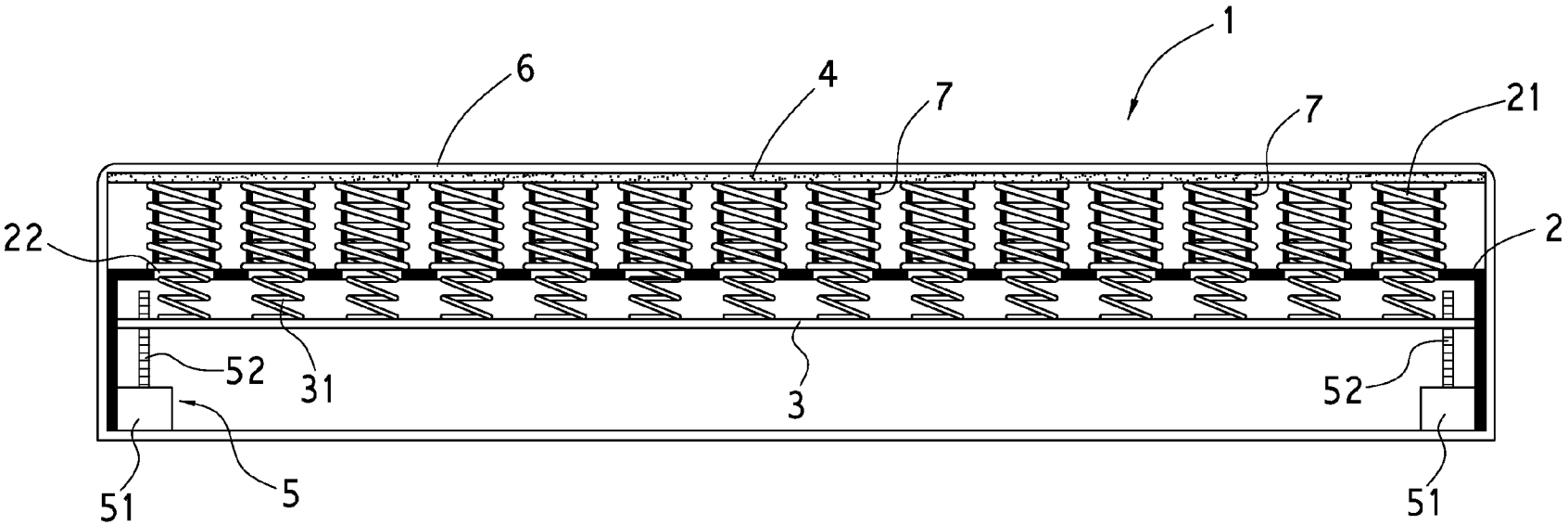
FIG. 8 illustrates a schematic sectional structural view of another preferred embodiment of the mattress structure of the present invention.

With reference to FIG. 8, which illustrates a schematic sectional structural view of another preferred embodiment of the mattress structure of the present invention. In the preferred embodiment, a guiding member 7 is disposed in a gap between the first flexible member 21 and the second flexible member 31 so as to avoid that an impact of the first flexible member 21 and the second flexible member 31 causes deformations for the first flexible member 21 and the second flexible member 31 due to angle deviations while the second flexible member 31 moves up to the first flexible member 21. Hence, the guiding member 7 guides the moving direction of the second flexible member 31 in order to avoid the deformations of the first flexible member 21 and the second flexible member 31. Further, the guiding member 7 is made of foam.

With the comparison to the prior art, the present invention has an advantage, that is, the moving plate can be adjusted for moving up and down so as to let the support forces of the first flexible member 21 be integrated with the support forces of the second flexible member 31 of the moving plate 3. Hence, the total support force of the mattress structure is adjustable for different users. So that the lowering distance of the mattress structure is controllable.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A mattress structure, which is a mattress body 1, comprising:

a fixed plate, which has a plurality of flexible accommodating holes and at least one first flexible member;

a moving plate, which has at least one second flexible member corresponding to the flexible accommodating hole, the moving plate being below the fixed plate and having a distance with the fixed plate for moving;

at least one lifting device, which is combined with the bottom of the moving plate, the moving plate and the second flexible member moving up and down via the lifting device in order to let that the second flexible member penetrates through the flexible accommodating holes and protrudes out of the top surface of the fixed plate.

2. The mattress structure according to claim 1, further comprising a remote control device, which is connected with the lifting device for controlling the lifting device.

3. The mattress structure according to claim 1, wherein the lifting device comprises a motor and a power-output axis disposed at the motor and connected with the moving plate.

4. The mattress structure according to claim 3, wherein the power-output axis is a ball screw rod.

5. The mattress structure according to claim 1, wherein the flexible accommodating holes are disposed at the bottom in the first flexible member.

6. The mattress structure according to claim 1, wherein the flexible accommodating holes are disposed between the two first flexible members.

7. The mattress structure according to claim 1, wherein the first flexible member and the second flexible member adopt a cell arrangement.

8. The mattress structure according to claim 1, wherein the first flexible member and the second flexible member adopt a parallel arrangement.

9. The mattress structure according to claim 1, wherein the first flexible member and the second flexible member adopt a regulated and staggered arrangement.

10. The mattress structure according to claim 1, wherein a gap between the first flexible member and the second flexible member is disposed a guiding member.

* * * * *

UNITED STATES PATENT AND TRADEMARK OFFICE

CERTIFICATE OF CORRECTION

PATENT NO. : 7,934,277 B1
APPLICATION NO. : 12/877275
DATED : May 3, 2011
INVENTOR(S) : Hsu

It is certified that error appears in the above-identified patent and that said Letters Patent is hereby corrected as shown below:

Title Page 1, Item (12) upper left corner, "Shu" should read --Hsu--

Title Page 1, Item (76) "Inventor: Han-Chung Shu, Taipei (TW)" should read --Inventor: Han-Chung Hsu, Taipei (TW)--

Signed and Sealed this
Sixth Day of March, 2012

David J. Kappos

David J. Kappos
*Director of the United States Patent and Trademark Office*